US005105919A

United States Patent [19]

Bomes et al.

[11] Patent Number: 5,105,919

[45] Date of Patent: Apr. 21, 1992

[54] DUFFLE BAG WITH WHEELS DISPOSED IN AN END WALL

[75] Inventors: Harvey J. Bomes; Jack L. Barber, both of Baltimore, Md.

[73] Assignee: The Baltimore Luggage Company, Baltimore, Md.

[21] Appl. No.: 581,056

[22] Filed: Sep. 12, 1990

[51] Int. Cl.[5] ..... A45C 5/06; A45C 5/14; A45C 13/10

[52] U.S. Cl. ..... 190/18 A; 190/109; 190/111; 190/119; 190/903; 150/117; 383/907

[58] Field of Search ..... 190/18 A, 18 R, 109, 190/111, 112, 119, 903; 150/117; 383/907; D3/48, 71, 77; 206/315.1; 280/37, 47.26

[56] References Cited

U.S. PATENT DOCUMENTS

| | | | |
|---|---|---|---|
| D. 231,042 | 3/1974 | Lee | D3/71 |
| D. 235,384 | 6/1975 | Theilkas | D3/71 |
| D. 254,894 | 5/1980 | Zoland | D3/71 X |
| D. 264,146 | 5/1982 | Davis | D3/76 X |
| D. 281,647 | 12/1985 | Bomes et al. | D3/48 X |
| D. 281,648 | 12/1985 | Bomes et al. | D3/48 X |
| D. 285,145 | 8/1986 | Hsieh | D3/76 |
| D. 285,748 | 9/1986 | Feinberg et al. | 190/103 X |
| D. 286,229 | 10/1986 | Knoepke et al. | 190/103 X |
| 1,101,490 | 6/1914 | Geissler | 150/117 |
| 1,520,932 | 12/1924 | Comstock | 190/109 X |
| 1,938,519 | 12/1933 | Deffenbaugh | 190/109 X |
| 3,163,826 | 12/1964 | Leavell | 190/18 A |
| 3,587,794 | 6/1971 | Mattel | 190/107 X |
| 3,948,365 | 4/1976 | Gregg et al. | 190/18 A |
| 4,026,570 | 5/1977 | Feinberg | 190/18 A X |
| 4,063,581 | 12/1977 | Williams | 190/18 A |
| 4,126,213 | 11/1978 | McDonald | 190/18 A |
| 4,210,186 | 7/1980 | Belenson | 190/111 X |
| 4,335,896 | 6/1982 | Koffler et al. | 190/18 A X |
| 4,358,137 | 11/1982 | Gramm | 206/315.1 X |
| 4,524,482 | 6/1985 | Mueller | 190/18 A X |
| 4,596,397 | 6/1986 | Conti | 190/18 A X |
| 4,738,342 | 4/1988 | Boitani | 190/111 |
| 4,756,394 | 7/1988 | Cohen | 190/18 A |
| 4,773,123 | 9/1988 | Yu | 190/18 A X |
| 4,773,515 | 9/1988 | Kotkins, Jr. | 190/103 |
| 4,805,749 | 2/1989 | Gerch | 190/111 |
| 4,830,154 | 5/1989 | Gerch et al. | 190/103 |
| 4,895,230 | 1/1990 | King | 190/103 X |
| 4,979,598 | 12/1990 | Verheis et al. | 190/18 A |

FOREIGN PATENT DOCUMENTS

| | | | |
|---|---|---|---|
| 2359229 | 6/1975 | Fed. Rep. of Germany | 190/18 A |
| 1549246 | 12/1968 | France | 190/111 |
| 2374866 | 8/1978 | France | 190/103 |
| 2397169 | 3/1979 | France | 190/111 |
| 2635954 | 3/1990 | France | 150/117 |
| 585845 | 2/1947 | United Kingdom | 190/111 |
| 911834 | 11/1962 | United Kingdom | 190/109 |

*Primary Examiner*—Sue A. Weaver
*Attorney, Agent, or Firm*—Breiner & Breiner

[57] ABSTRACT

A duffle bag comprised of a top wall, a bottom wall, front and back side walls, and end walls constructed to define a main storage compartment and separate end storage compartments, and at least one of the end storage compartments includes wheel assembly means for transporting the duffle bag. A further aspect of the duffle bag includes end storage compartments which are rigid and will pop open automatically when unfastened to provide a large opening to facilitate packing.

20 Claims, 2 Drawing Sheets

DUFFLE BAG WITH WHEELS DISPOSED IN AN END WALL

FIELD OF THE INVENTION

This invention relates to duffle bags. More particularly, the invention relates to a duffle bag having wheels attached to an end compartment of the duffle bag for rolling the duffle bag and to a duffle bag having end compartments which automatically pop open when unfastened.

BACKGROUND OF THE INVENTION

Duffle bags have long been known in the art for carrying personal belongings. Generally, duffle bags have been made of a soft, flexible material such as canvas or duck having a slit opening in the top of the bag for packing and unpacking personal belongings. In recent years, duffle bags have been modified to include end compartments such as disclosed in U.S. Pat. Nos. 4,830,154 and Des. 235,384 and to be collapsible and self-erecting such as disclosed in U.S. Pat. No. 4,895,230. Duffle bags are carried by handle straps extending from the sides of the bag or a handle at one end of the bag or by a shoulder strap. However, carrying a duffle bag for any length of time by such means is tiresome due to the weight and the sometimes cumbersome nature of the bag. In the past, duffle bags have not included wheels for rolling the duffle bag. This is presumably due to a number of factors including the flexible unstructured nature of the duffle bag, the difficulty in the manufacture of a duffle bag with wheels, and the prohibitive cost of such manufacture.

While duffle bags have not included wheels, it is known to use wheels on luggage comprised of two rigid shell sections such as disclosed in U.S. Pat. Nos. 3,163,268; 3,948,365; 4,026,570; 4,335,896; 4,524,482; 4,773,123; and Des. 285,145. Additionally, hand-carried bags have included various types of wheel assemblies such as disclosed in U.S. Pat. Nos. 587,794; 4,126,213; 4,596,397; and 4,756,394. However, the aforementioned luggage and hand bags have different characteristics than a duffle bag and the teaching of such wheel assemblies is not particularly applicable to duffle bags.

Further, the above-described duffle bags have additional drawbacks. For example, they are difficult to pack and unpack due to the narrow slit openings providing access to the main storage compartment or to the end compartments. It is desirable that the duffle bag include large openings for easier packing, particularly in the end compartments where bulky items such as shoes and the like may be packed.

The present invention overcomes the above-mentioned drawbacks by providing wheel assembly means for rolling the duffle bag and by providing large openings into the end compartments and the main storage compartment of the duffle bag as more fully described hereafter.

PRIMARY OBJECTS AND SUMMARY OF THE INVENTION

It is a primary object of the present invention to provide a new and novel duffle bag having a wheel assembly means for ease in transporting the duffle bag and for allowing a large or jumbo duffle bag with increased packing capacity.

It is a further primary object of the invention to provide a duffle bag having rigid end compartments which will automatically pop open when unfastened and provide for a wide opening to facilitate packing and unpacking.

It is a further object of the invention to provide a duffle bag including rigid end compartments allowing for simple, inexpensive, and efficient means for attaching the wheel assembly to the duffle bag.

It is another object of the invention to provide a duffle bag including rigid end compartments for the attachment of a wheel assembly means which will provide balance and stability to the duffle bag when the duffle bag is rolled on the wheel assembly means.

It is a further object of the invention to provide a duffle bag which is durable, attractive in appearance, simple in design and manufacture, and easy to use by the traveler.

The duffle bag of the present invention is comprised of a top wall, a bottom wall, front and back side walls, and end walls constructed to define a main storage compartment and separate end storage compartments, and at least one of the end walls include wheel assembly means for transporting the duffle bag.

A further important aspect of the invention includes a duffle bag having a top wall, a bottom wall, front and back side walls, and end walls constructed to define a main storage compartment and separate end storage compartments wherein the end storage compartments are rigid and will pop open automatically when unfastened to provide a large opening to facilitate packing.

Other objects and advantages of the invention will become apparent from the drawing and description of the invention.

DESCRIPTION OF THE PRESENTLY PREFERRED EMBODIMENT

Figure 1:
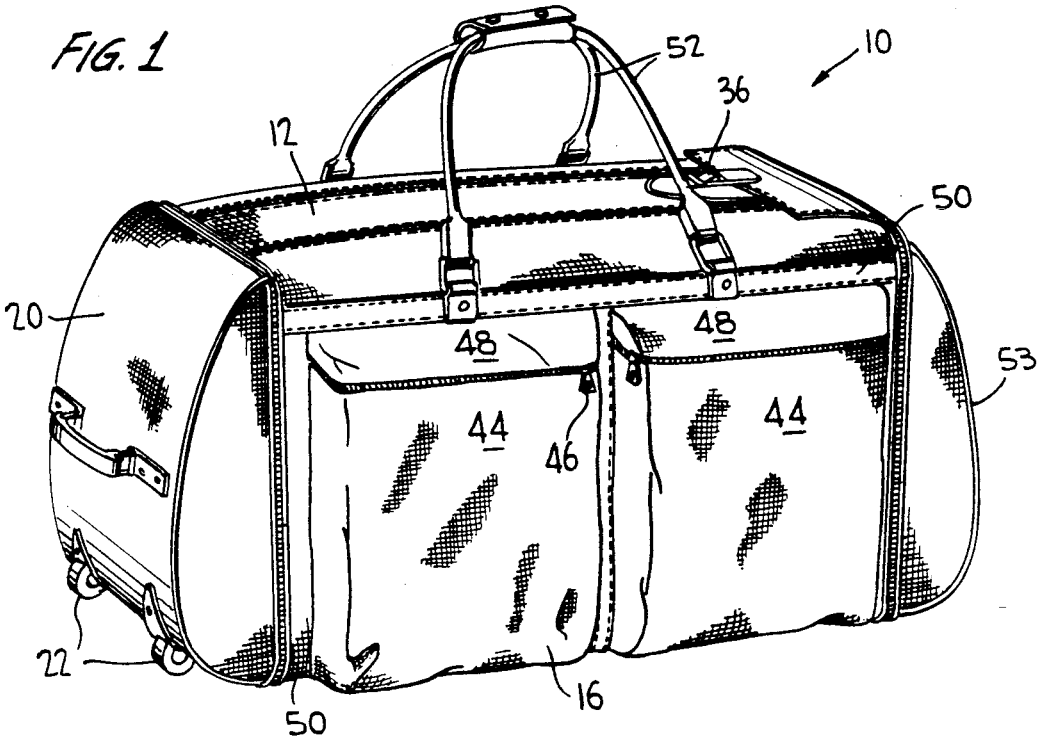
FIG. 1 is a perspective view of the duffle bag having wheel assembly means according to the present invention.
Figure 2:
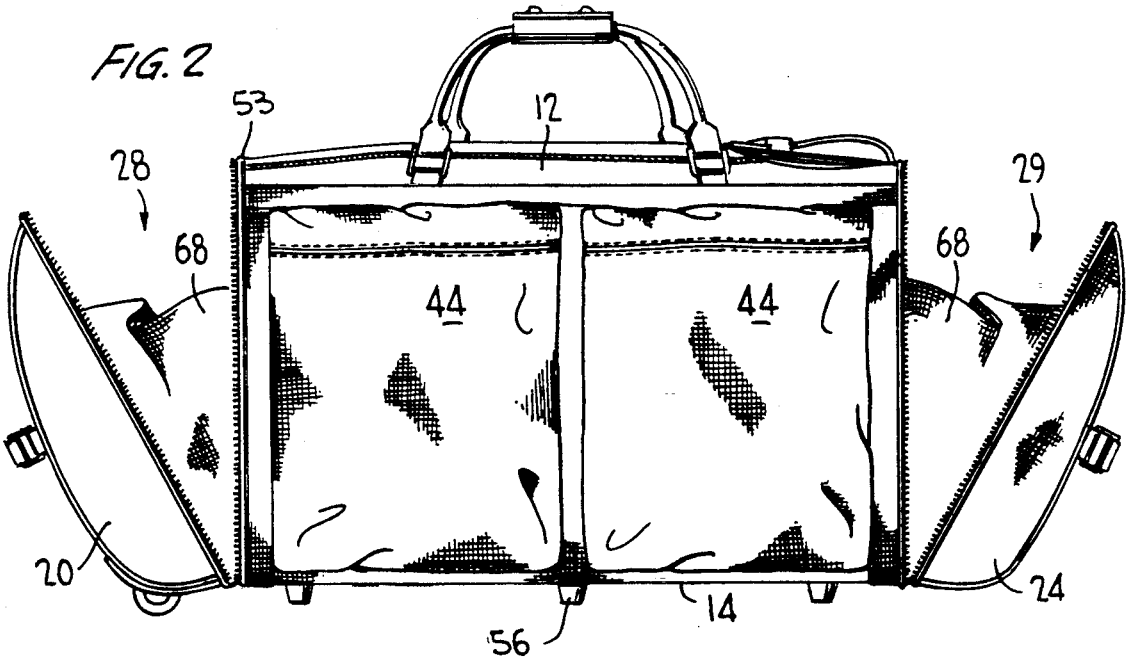
FIG. 2 is a front elevational view of the invention showing the end compartments in the opened position.
Figure 3:
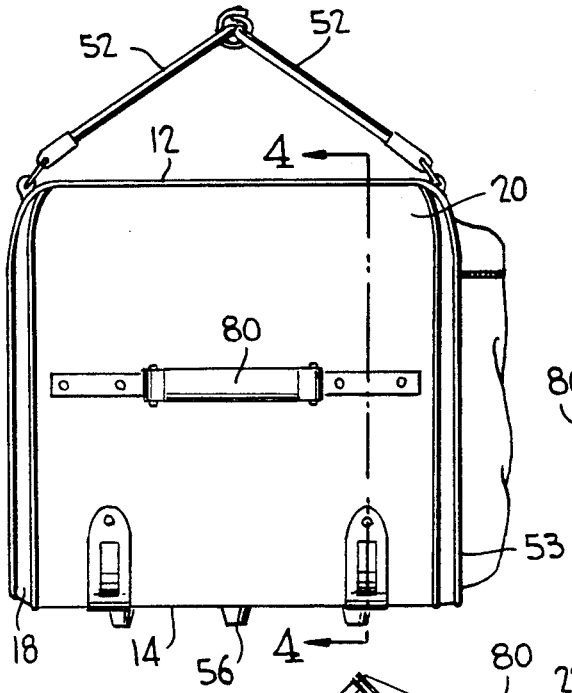
FIG. 3 is a left end elevational view of the invention showing the wheel assembly means.

The duffle bag 10 of the present invention generally includes top wall 12, bottom wall 14, front side wall 16, back side wall 18, left end wall 20 having wheel assembly means 22, and right end wall 24. These walls are stitched together and define a main storage compartment 26 (FIG. 5) and separate end storage compartments 28 and 29 (FIG. 2). The front, bottom and side walls of the duffle bag are made of a durable, lightweight, flexible plastic material which in the preferred embodiment is nylon with a polyvinyl chloride backing. The end compartments are made of a rigid material and covered with the same nylon material as the other walls as described more fully hereafter. It is understood that the bag may be made of other lightweight materials such as plastic, cloth, and the like.

Figure 5:
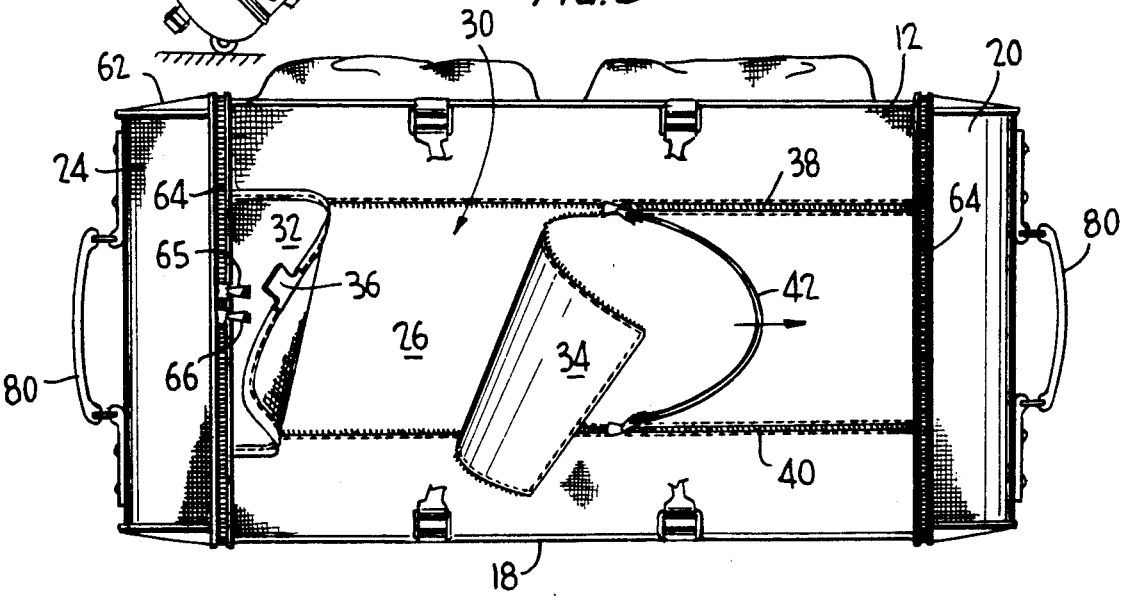
FIG. 5 is a top plan view of the invention showing the duffle bag partially opened to the main storage compartment.

Top wall 12 includes opening 30 to main storage compartment 26 for packing and unpacking personal belongings. Opening 30 is formed by a top flap 32 which latches to an adjacent lower elongated flap 34. Flaps 32 and 34 include a conventional latch mechanism 36. Flap 32 overlies flap 34 to protect the storage compartment from the outside elements. Flap 34 is attached to the top wall 12 by stitching and parallel track zipper means 38 and 40 which provide for a large opening to facilitate packing of the duffle bag. Zipper means 38 and 40 are concurrently opened and closed by pull strap 42 as best shown in FIG. 5. It is understood that opening 30 may be formed by other means such as a curved zipper opening means.

Front side wall 16 includes individually accessible side pockets 44 which extend outwardly and away from side wall 16 for carrying articles separate from the main storage compartment 26. Side pockets 44 are opened and closed by zipper closure means 46 and include outwardly extending, top opening flaps 48. Flaps 48 facilitate packing since they extend outwardly and away from side wall 16 and lift up to open as opposed to the conventional slit openings used for duffle bag side pockets.

Side walls 16 and 18 may include trim strips 50 to cover the stitching means joining the side walls to the top wall and the side walls to the end wall. Trim strips further provide means to cover and protect the attachment of handle straps 52 which are attached to the side walls by rivets or other suitable fastening means. The duffle bag includes beading 53 which provides an attractive appearance to the duffle bag, provides a means for covering the stitching, adds strength to the bag, and gives the bag shape.

Bottom wall 14 includes an interior rigid floor 54 (FIG. 4) which covers substantially the entire surface of the bottom wall. The floor material may be plastic or cardboard and, in the preferred embodiment, is covered by a durable plastic material such as polyvinyl chloride. Extending outward and downwardly from the bottom wall 14 are a plurality of feet members 56.

Figure 4:
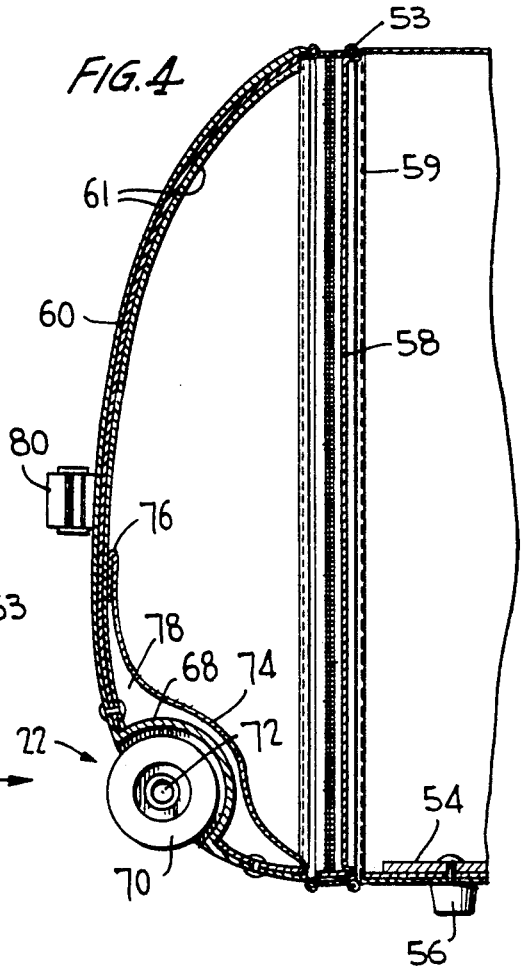
FIG. 4 is a partial front elevational view in cross section of the invention taken along lines 4—4 of FIG. 3.

Referring to FIG. 4, flexible partitions 58 are provided between end walls 20 and 24 and the top, bottom, and side walls 12, 14, 16, and 18 to provide the main storage compartment 26 and end storage compartments 28 and 29.

End walls 20 and 24 are generally rigid in structure. End walls 20 and 24 are comprised of an end panel 60 and side panels 62. End panel 60 is formed of a flat flexible piece of hard plastic such as ethylene-vinyl acetate copolymer (EVA) as shown in FIG. 4. The EVA is flexed or bent to provide a curved surface and covered with the nylon covering material 61. In the preferred process of manufacture, the EVA is flexed and placed in prefabricated nylon pockets which are not as large as the flat piece of EVA and then stitched closed and covered by beading 53, thereby retaining the EVA in the flexed, curved position and providing the curved shape to the end walls 20 and 24. Side panels 62 are also rigid and, in the preferred embodiment, are made of a thin polyurethane foam covered with the nylon covering material. End walls 20 and 24 are each fastened by a zipper fastening means 64 which extend around the top and side walls of the duffle bag and are fastened and unfastened by zipper slide pulls 65 and 66. When the zipper means is unfastened, the end compartment automatically pops open due to the curved construction of the end wall using the flexed rigid material. The opening of the end compartments 28 and 29 is controlled in part by gussets 68.

End wall 20 includes wheel assembly means 22. Wheel assembly means 22 are attached at the base of end wall 20 as best shown in FIG. 4. Specifically, slots are made in the EVA 60 through which wheel assembly means 22 are inserted and attached to end wall 20 by rivets or other suitable attachment means. Wheel assembly means 22 include a resilient plastic housing material 68 and wheels 70 rotated about an axle 72. The plastic housings 68 of wheel assembly means 22 are interiorly covered by nylon flap 74 which may be attached by stitching at its base and by Velcro fastening means 76 to provide a separate compartment 78. In the preferred embodiment, two wheel assembly means 22 are utilized at one of the end walls. However, it is understood that a single wide wheel may be used or that two wheel assembly means 22 may be attached to each of end walls 20 and 24.

Figure 6:
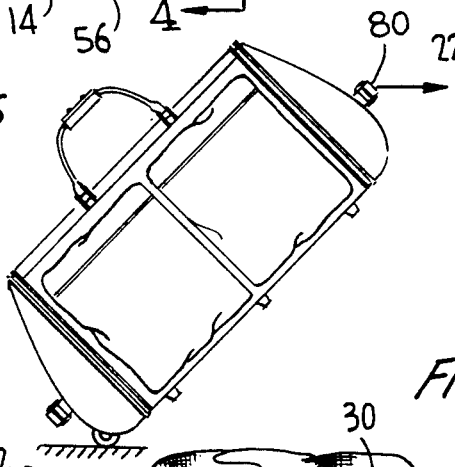
FIG. 6 is a perspective view of the duffle bag being rolled on the wheel assembly means.

End walls 20 and 24 further include a handle means 80. Handle means 80 of end wall 24 is used to lift, pull and guide the duffle bag on the wheel assembly 22 as shown when rolled in FIG. 6.

As seen from the above description, it will be apparent that the duffle bag of the present invention provides for a new and novel duffle bag having a wheel assembly means for easier transport of the duffle bag. Further, the duffle bag of the invention provides for large opening end compartments for easy packing and which will automatically pop open when unfastened. Thus, the duffle bag of the invention provides for a durable, lightweight, and attractive duffle bag which, due to its simple design, is easy to manufacture and easy to use.

It will be apparent to one skilled in the art that various modifications of the duffle bag of the present invention can be made by one skilled in the art without departing from the spirit of the scope of the invention as set forth in the appended claims.

It is claimed:

1. A duffle bag comprising a top wall, a bottom wall, front and back side walls, and opposing end walls to define a main storage compartment, wherein at least said top and side walls are flexible; said top wall having an opening means for providing access to said main storage compartment, and at least one end storage compartment, and at least one of said end walls of said end storage compartment including a wheel assembly means connected thereto for rolling said duffle bag wherein said wheel assembly means is constructed and arranged to be at least partially recessed into said end wall.

2. A duffle bag according to claim 1 wherein said top wall and front and back side walls are flexible and said bottom wall and end walls are rigid.

3. A duffle bag according to claim 1 wherein said end storage compartment is comprised of a partition dividing said main storage compartment and said end storage compartment, said end wall being rigid and comprised of a rigid end panel curved outwardly from said main storage compartment and rigid side panels, and a fastening means too open and close said end compartment, wherein when said fastening means is unfastened said end compartment will automatically pop open.

4. A duffle bag according to claim 3 wherein said fastening means is a zipper.

5. A duffle bag according to claim 4 wherein said fastening means extends around the periphery of said top and side walls.

6. A duffle bag according to claim 1 wherein said opening means of said top wall includes an opening to said main storage compartment comprising a first flap connected to said top wall and overlying a second elongated flap connected to said top wall and having parallel zipper means for opening said second flap.

7. A duffle bag according to claim 1 wherein at least one of said end walls includes a handle means.

8. A duffle bag according to claim 1 wherein said front wall includes at least one side storage pocket.

9. A duffle bag according to claim 8 wherein said side storage pocket extends outwardly from said mains storage compartment and includes a top opening flap.

10. A multiple compartment duffle bag having a main storage compartment comprised of a top wall and a bottom wall, opposing side walls, and opposing end walls wherein at least said top and side walls are flexible, and at least one end storage compartment, said end storage compartment including a partition dividing said main storage compartment and said end storage compartment, said end wall being rigid and curved outwardly from said end storage compartment, and a fastening means to open and close said end compartment, wherein when said fastening means is unfastened said end compartment will automatically pop open.

11. A duffle bag according to claim 10 wherein at least one of said end walls includes a wheel assembly means.

12. A duffle bag according to claim 10 wherein said rigid end wall adjacent said main storage compartment includes a rigid end panel curved outwardly from said main storage compartment and rigid side panels.

13. A duffle bag according to claim 12 wherein said end wall includes a wheel assembly means.

14. A duffle bag according to claim 10 wherein said fastening means is a zipper.

15. A duffle bag according to claim 14 wherein said zipper extends around the periphery of said top and side walls.

16. A duffle bag according to claim 10 wherein one of said side walls includes at least one side storage pocket 7.

17. A duffle bag according to claim 16 wherein said side storage pocket extends outwardly from said main storage compartment and includes a top opening flap.

18. A duffle bag according to claim 10 wherein said top wall includes an opening too said main storage compartment comprising a first flap connected to said top wall and overlying a second elongated flap connected to said top wall and having parallel zipper means for opening said flap to said main storage compartment.

19. A duffle bag according to claim 18 wherein said parallel zipper means includes a pull strap.

20. A duffle bag comprising a top wall, a bottom wall, front and back side walls, and opposing end walls to define a storage compartment, wherein at least said top and side walls are flexible; said top wall having an opening means for providing access to said storage compartment and at least one of said end walls being at least partially rigid and including a wheel assembly means for rolling said duffle bag wherein said wheel assembly means is constructed and arranged to be at least partially recessed into said rigid portion of said end wall.

* * * * *